US005395247A

United States Patent [19]

Garzon

[11] Patent Number: 5,395,247

[45] Date of Patent: Mar. 7, 1995

[54] SLIDING CONTACT

[75] Inventor: Ruben D. Garzon, Columbia, S.C.

[73] Assignee: ABB Power TD & Company, Blue Bell, Pa.

[21] Appl. No.: 151,550

[22] Filed: Nov. 12, 1993

[51] Int. Cl.[6] ..... H01R 39/28

[52] U.S. Cl. ..... 439/17; 384/518

[58] Field of Search ..... 384/500, 504, 505, 518; 439/17, 19

[56] References Cited

U.S. PATENT DOCUMENTS

| | | | |
|---|---|---|---|
| 724,834 | 4/1903 | Farr | 384/500 |
| 3,175,181 | 3/1965 | Grabbe | 439/886 |
| 3,271,723 | 9/1966 | Willing | 439/17 |
| 3,564,477 | 2/1971 | Pompei | 439/17 |
| 3,853,382 | 12/1974 | Lazar | 439/886 |
| 5,139,425 | 8/1992 | Daviet et al. | 439/17 |
| 5,208,978 | 5/1993 | Dixon et al. | 439/886 |

FOREIGN PATENT DOCUMENTS

| | | | |
|---|---|---|---|
| 590764 | 6/1925 | France | 384/518 |

*Primary Examiner*—Gary F. Paumen

*Attorney, Agent, or Firm*—Woodcock Washburn Kurtz Mackiewicz & Norris

[57] ABSTRACT

A sliding contact comprises a stationary contact member having an opening extending therethrough and a movable contact member, at least a portion of which is disposed within the opening. Conductive bearing means are disposed within the opening between the stationary contact member and the movable contact member for supporting the movable contact member within the opening and for maintaining an electrical connection between the movable contact member and the stationary contact member. Preferably, the conductive bearing means comprises a plurality of conductive ball bearings.

7 Claims, 2 Drawing Sheets

SLIDING CONTACT

BACKGROUND OF THE INVENTION

1. Field of the Invention

The present invention relates generally to electrical contacts and, more particularly, to sliding contacts wherein one contact member moves relative to the other contact member.

2. Description of the Prior Art

In any type of electrical apparatus that carries current and has moving parts, e.g., electrical switch gear, circuit breakers, etc., there is a need for some type of sliding contact to transfer current from the moving contact member to the stationary contact member. Prior art sliding contacts, including flexible shunts, spring loaded segmented contacts and spring washers, have various disadvantages. For example, some are only capable of rotary motion, while others are suited only for linear motion. Other prior art sliding contacts have limited travel, and many tend to be complicated and expensive. As a result, there is a need for a sliding contact that is compact, relatively simple to manufacture, easy to adjust for higher currents, suitable for any length of linear motion, and able to handle rotary motion as well. The present invention satisfies these needs.

SUMMARY OF THE INVENTION

Briefly stated, the present invention is directed to a sliding contact that comprises a stationary contact member having an opening extending therethrough, a movable contact member at least a portion of which is disposed within the opening, and conductive bearing means disposed within the opening between the stationary contact member and the movable contact member. The conductive bearing means supports the movable contact member within the opening and maintains an electrical connection between the movable contact member and the stationary contact member as the movable contact member slides within the opening over the bearing means. Preferably, the conductive bearing means comprises a plurality of conductive ball bearings at least partially surrounding the movable contact member within the opening.

According to a preferred embodiment, the movable contact member and the opening in the stationary contact member are cylindrical, and the movable contact member is operable to move linearly within the cylindrical opening. Alternatively, the movable contact member may rotate within the opening about the cylindrical axis thereof.

Means may be mounted on the stationary contact member for adjustably imparting a force on the conductive bearing means to urge the bearing means against the movable contact member. In the preferred embodiment, the force imparting means comprises a plurality of pressure plates pivotally mounted on the stationary contact member proximate the opening thereof. Each of the pressure plates is operable to pivot against the bearing means thereby urging the bearing means against the movable contact member.

Other features and advantages of the present invention will become evident hereinafter.

BRIEF DESCRIPTION OF THE DRAWINGS

The foregoing summary, as well as the following detailed description of the preferred embodiments, is better understood when read in conjunction with the appended drawings. For the purpose of illustrating the invention, there is shown in the drawings, an embodiment that is preferred, it being understood, however, that the invention is not limited to the specific methods and instrumentalities disclosed. In the drawings.

DESCRIPTION OF THE PREFERRED EMBODIMENT

Figure 1:
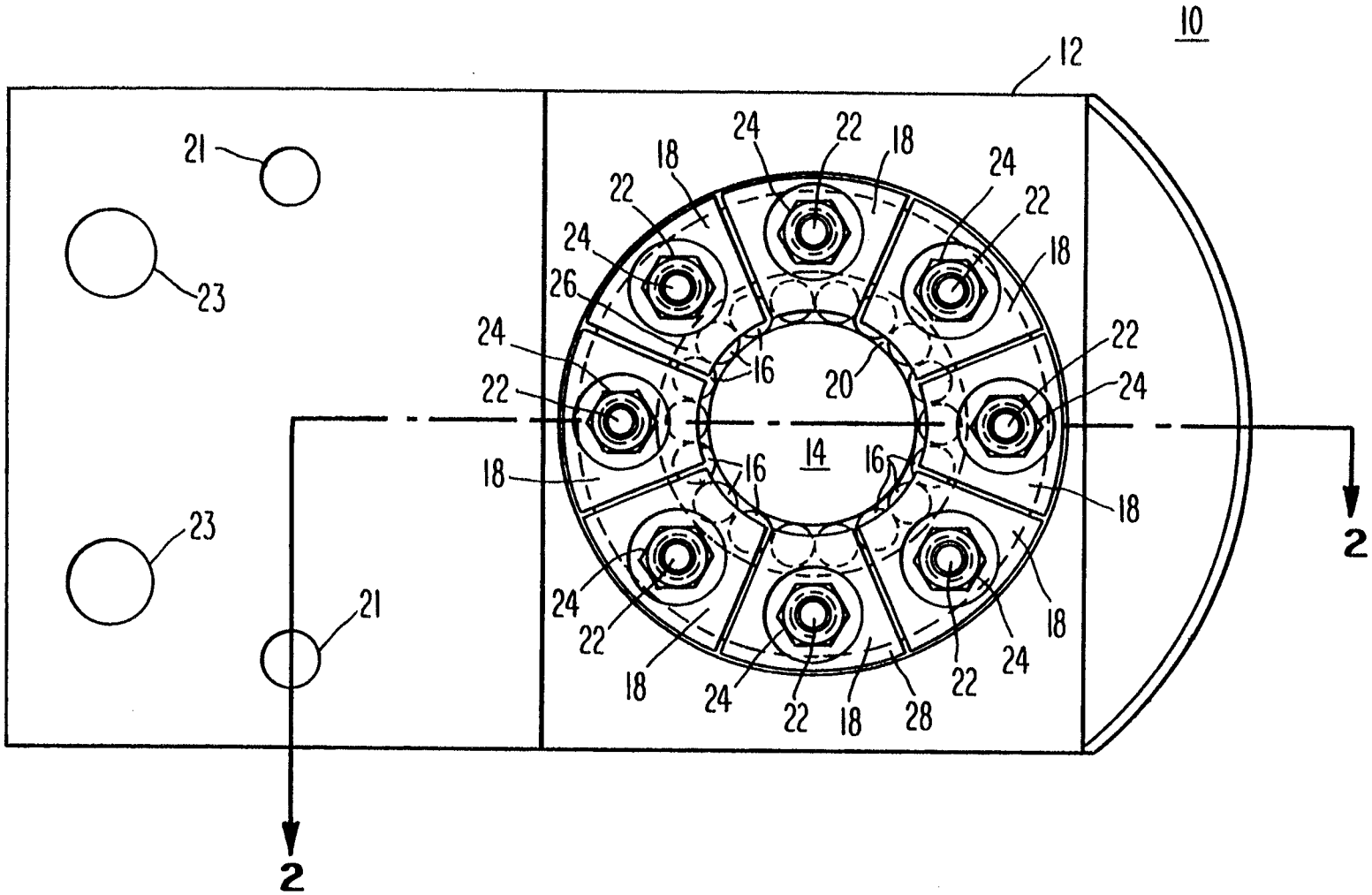
FIG. 1 is a top view of a sliding contact according to a preferred embodiment of the present invention.

Referring to the drawings wherein like numerals indicate like elements throughout, there is shown in FIG. 1 a top view of a sliding contact 10 according to a preferred embodiment of the present invention. As shown, the sliding contact 10 comprises a stationary contact member 12 having an opening 20 extending therethrough, and a movable contact member 14 at least a portion of which is disposed within the opening 20. The stationary and movable contact member 12, 14 are made of an electrically conductive material, such as copper, and may be plated with silver, tin or any other suitable material to prevent oxidation. According to the preferred embodiment, the movable contact member 14 and the opening 20 extending through the stationary contact member 12 are cylindrical, i.e., both have a circular cross-section. In other embodiments, however, the opening 20 and movable contact member 14 may have other cross-sectional shapes, such as, for example, square or triangular cross-sections. Mounting holes 21, 23 are provided on the stationary contact member 12 for mounting the stationary contact member 12 in, for example, an electrical switch gear or circuit breaker housing.

Conductive bearing means are disposed within the opening 20 between the stationary contact member 12 and the movable contact member 14. According to the preferred embodiment, the conductive bearing means comprises a plurality of conductive ball bearings 16. As shown, the plurality of ball bearings 16 form a ring surrounding the movable contact member 14 to support the movable contact member 14 within the opening 20. Each ball bearing 16 provides an electrical connection between the movable contact member 14 and the stationary contact member 12. Each ball bearing 16 is formed of an electrically conductive material, such as copper. Like the stationary and movable contact members 12, 14, the ball bearings 16 may be plated with silver, tin or any other suitable material to prevent oxidation.

Figure 2:
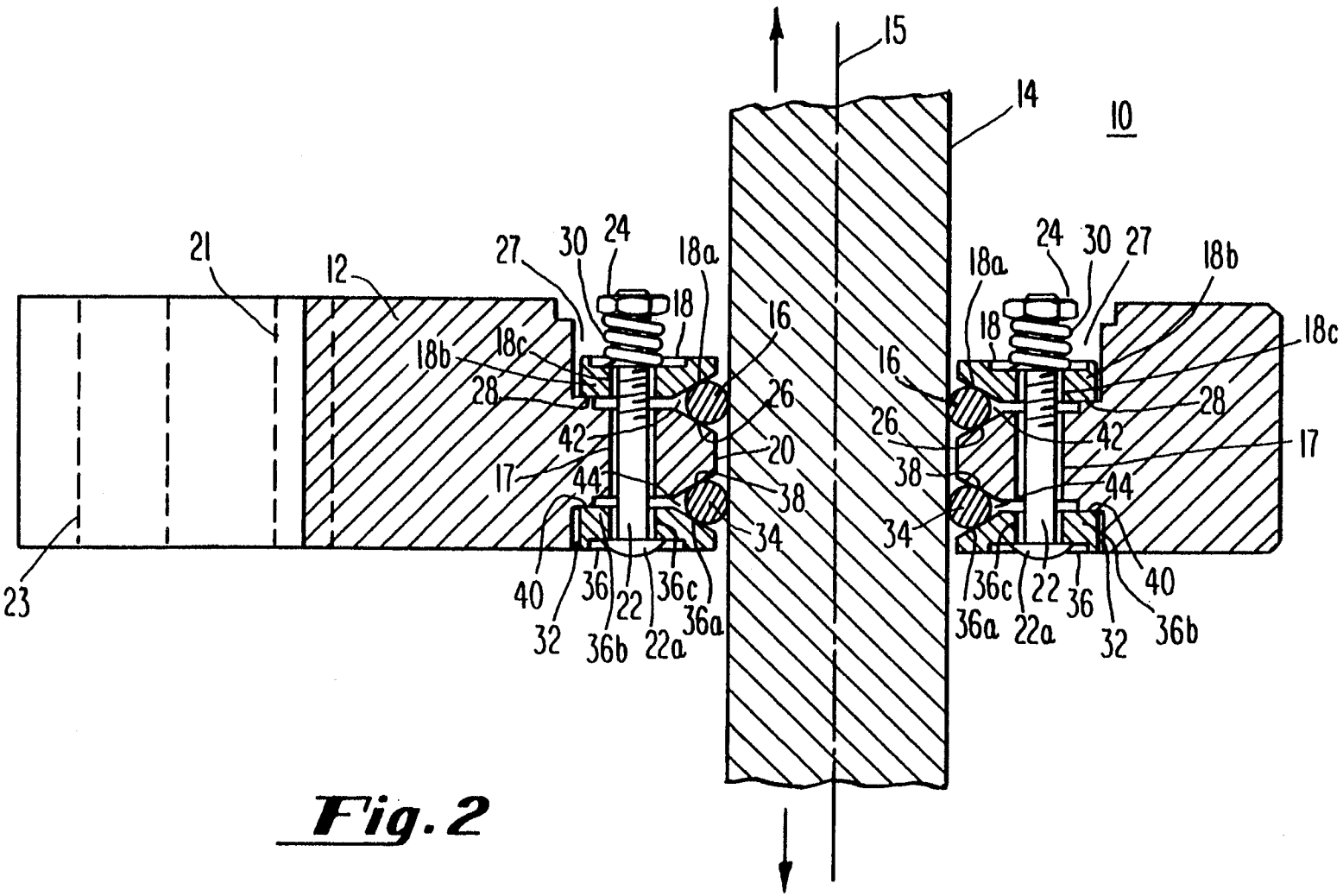
FIG. 2 is a side view of the sliding contact of FIG. 1 taken along line 2—2 of FIG. 1.

FIG. 2 is a cross-sectional view of the sliding contact 10 of FIG. 1 taken along line 2—2 of FIG. 1. As S shown, in the preferred embodiment, a second plurality of conductive ball bearings 34 are disposed in the opening 20 to provide additional support for the movable contact member 14. The second plurality of conductive ball bearings 34 also form additional electrical connections between the movable contact member 14 and the stationary contact member 12. Other than their positioning within the opening 20, the second plurality of conductive ball bearings 34 are identical to the first plurality of ball bearings 16. Although two rings of ball bearings 16, 34 are employed in the preferred embodiment, it is understood that the present invention is by no means limited thereto. For example, a single ring of ball bearings may be employed, or alternatively, three or more rings of ball bearings may be employed. The electrical current rating of the sliding contact 10 will be proportional to the number of conductive ball bearings employed.

Each end 26, 38 of the opening 20 in the stationary contact member 12 is beveled. A first plurality of pressure plates 18 are pivotally mounted on the stationary contact member 12 proximate one end of the opening 20, i.e., beveled end 26, and a second plurality of pressure plates 36 are pivotally mounted on the stationary contact member 14 proximate the other beveled end of the opening 20, i.e., beveled end 38. Preferably, the first and second sets of pressure plates 18, 36 are mounted in respective annular recesses 27, 32 formed in the stationary contact member 14 about the respective ends 26, 38 of the opening 20. Both sets of pressure plates 18, 36 are positioned on the stationary contact member such that their distal ends 18*a*, 36*a* form a ring about the respective ends 26, 38 of the opening 20.

The distal ends 18*a*, 36*a* of each pressure plate 18, 36 are also beveled. As shown, the beveled ends 18*a* of each pressure plate 18 cooperate with the beveled end 26 of the opening 20 to form an annular channel 42 about the opening 20. Likewise, the beveled ends 36*a* of the second set of pressure plates 36 cooperate with the other beveled end 38 of the opening 20 to form a second annular channel 44 about the opening 20. Each of the first plurality of conductive ball bearings 16 are at least partially disposed within the first annular channel 42, and each of the second plurality of ball bearings 34 are at least partially disposed with the second annular channel 44. The ball bearings 16, 18 are retained within their respective annular channels 42, 44 by the movable contact member 14.

The back end 18*b* of each of the first set of pressure plates 18 rests on a ledge 28 formed at the rear corner of recess 27. The ledge 28 serves as a fulcrum for each pressure plate 18. Similarly, the back end 36*b* of each of the second set of pressure plates 36 rests on a ledge 40, at the rear corner of recess 32, which serves as a fulcrum for each of those pressure plates 36. Preferably, each of the first set of pressure plates 18 is mounted on the stationary contact member directly opposite a corresponding one of the pressure plates 36 mounted at the other end of the opening 20, thereby defining a number of opposing pairs of pressure plates.

In the preferred embodiment, the pressure plates 18, 36 are mounted on the stationary contact member 12 using elongate bolts 22 inserted through apertures 18*c*, 36*c* in each pair of opposing pressure plates 18, 36. The apertures 18*c*, 36*c* in each pair of opposing pressure plates 18, 36 are aligned with corresponding apertures 17 extending through the stationary contact member 12 between recesses 27 and 32. A spring 30 is mounted over the threaded end of each bolt 22, and each bolt is then secured with a nut 24.

For each pair of opposing pressure plates, the bolt 22, spring 30 and nut 24 provide a means for applying an adjustable pivoting force to the respective pressure plates to cause the plates to pivot about their respective fulcrums. Considering a particular pair of opposing pressure plates 18, 36 in greater detail, as the nut 24 is tightened, the spring 30 is compressed against the adjacent pressure plate 18 causing the pressure plate 18 to pivot about its fulcrum. As a result, the beveled distal end 18*a* of the pressure plate 18 is forced against the ball bearings 16 adjacent that pressure plate. The beveled end 26 of the opening 20 cooperates with the beveled distal end 18*a* of the pressure plate 18 to urge the respective ball bearings 16 against the movable contact member 14 in response to the applied force. At the same time, the head 22*a* of the bolt 22 compresses against the opposite pressure plate 36 causing the beveled distal end 36*a* of that pressure plate 36 to pivot against the ball bearings 34 adjacent that pressure plate 36. The beveled end 38 of the opening 20 cooperates with the beveled distal end 36*a* of the pressure plate 36 to urge the ball bearings 34 against the movable contact member 14. The force applied to each pressure plate 18, 36, and consequently, the force applied to each of the ball bearings 16, 34, can be adjusted by tightening or loosening the respective nuts 24. As broadly defined in the claims, the pressure plates 18, 36 and spring-loaded bolts 22 collectively define a means for adjustably imparting a force on the conductive bearing means to urge the bearing means against the movable contact member.

In use, the stationary contact member 12 is mounted to a fixed location so that, in a nominal position, at least a portion of the movable contact member 14 is disposed within the opening 20. The movable contact member 14 typically will be the moving portion of another electrical assembly. For example, in vacuum circuit breaker applications, the movable contact member 14 may be the moving contact of a vacuum interrupter. As explained above, the function of the sliding contact 10 of the present invention is to transfer current from the movable contact member 14 to the stationary contact member 12 while the movable contact member 14 moves relative to the stationary contact member 12. As indicated by the arrows in FIG. 2, the movable contact member 14 is operable to move linearly within the opening 20. One advantage of the sliding contact 12 of the present invention is that the stationary contact member 14 imposes no limits on the linear travel of the movable contact member 14. Consequently, the sliding contact 10 of the present invention is particularly well suited for applications in which the moving contact has a relatively long stroke, such as in $SF_6$ gas puffer breakers, or any type of disconnect switch. When the opening 20 and movable contact member 14 are cylindrical, as in the preferred embodiment, the movable contact member 14 can also rotate about the cylindrical axis 15 of the opening 20. In other embodiments, wherein the opening 20 and movable contact member 14 are not cylindrical, rotary motion may not be possible.

The electrical current capability of the sliding contact 10 is dependent upon both the number of conductive ball bearings 16, 34 employed and the force applied to the ball bearings 16, 34, by the respective pressure plates 18, 36, normal to the surface of the movable contact member 14. For a given current rating, the number of conductive ball bearings is inversely proportional to the magnitude of the force applied to the ball bearings. That is:

$$I^2 \approx N^2 \times F$$

where I is the maximum current the sliding contact 10 can handle, N is the number of conductive ball bearings (i.e., the number of contact points between the stationary and movable contact members), and F is the force applied to each ball bearings in a direction normal to the surface of the movable contact member. Thus, by increasing the number of conductive ball bearings, the force required to achieve a given current rating can be reduced. Reducing the required force on the ball bearings in turn reduces the friction between the ball bearings and the movable contact member 14.

The present invention may be embodied in other specific forms without departing from the spirit or essential attributes thereof and, accordingly, reference should be made to the appended claims, rather than to the foregoing specification, as indicating the scope of the invention.

What is claimed is:

1. A sliding contact comprising:

a stationary contact member having an opening extending therethrough;

a movable contact member, at least a portion of which is disposed within said opening; and conductive bearing means disposed within said opening between said stationary contact member and said movable contact member for supporting said movable contact member within said opening and for maintaining an electrical connection between said movable contact member and said stationary contact member as said movable contact member slides within said opening over said bearing means;

said stationary contact member having means mounted thereon for adjustably imparting a force on said conductive bearing means to urge said bearing means against said movable contact member;

said force imparting means comprising a plurality of pressure plates pivotally mounted on said stationary contact member proximate the opening thereof, each of said pressure plates being operable to pivot against said bearing means thereby urging said bearing means against said movable contact member.

2. A sliding contact comprising:

a stationary contact member having a cylindrical opening extending therethrough, at least one end of said opening being beveled;

a plurality of pressure plates each pivotally mounted on said stationary contact member with their distal ends disposed proximate the beveled end of said opening and positioned in a ring about said beveled end, the distal end of each pressure plate being beveled, the beveled ends of each pressure plate cooperating with the beveled end of said opening to form an annular channel about said opening;

a cylindrical movable contact member, at least a portion of which is disposed within said opening; and a plurality of conductive ball bearings each partially disposed within said annular channel and forming a ring about said movable contact member, said conductive ball bearings supporting said movable contact member within said opening and forming an electrical connection between said movable contact member and said stationary contact member, said movable contact member being operable to slide linearly in said opening over said conductive ball bearings.

3. A sliding contact as recited in claim 2 wherein said movable contact member is further operable to rotate in said opening about the cylindrical axis thereof.

4. A sliding contact as recited in claim 2 wherein each pressure plate has means for applying a force thereto to pivot the beveled distal end thereof against respective ones of said conductive ball bearings, the beveled end of each pressure plate cooperating with the beveled end of the opening in the stationary contact member to urge said respective ball bearings against the movable contact member in response to the respective forces applied thereto.

5. A sliding contact as recited in claim 2 wherein said stationary contact member, said movable contact member and said conductive ball bearings are made of copper.

6. A sliding contact as recited in claim 5 wherein said stationary contact member, said movable contact member and said conductive ball bearings are plated with one of silver and tin.

7. A sliding contact as recited in claim 2 wherein the other end of said opening is also beveled, and wherein said sliding contact further comprises:

a second plurality of pressure plates each pivotally mounted on said stationary contact member and positioned thereon such that their distal ends are disposed in a ring about said other beveled end of said opening, the distal ends of each of said second plurality of pressure plates being beveled, the beveled ends of each of said second plurality of pressure plates cooperating with said other beveled end of said opening to form a second annular channel about said opening; and a second plurality of conductive ball bearings each partially disposed within said second annular channel, said second plurality of conductive ball bearings providing additional support to said movable contact member and providing additional electrical connections between said movable contact member and said stationary contact member.

* * * * *